US006060438A

United States Patent [19]

Oleksiak

[11] Patent Number: 6,060,438

[45] Date of Patent: May 9, 2000

[54] EMULSION FOR THE HOT ROLLING OF NON-FERROUS METALS

[75] Inventor: Thomas P. Oleksiak, Aurora, Ill.

[73] Assignee: D. A. Stuart, Warrenville, Ill.

[21] Appl. No.: 09/179,531

[22] Filed: Oct. 27, 1998

[51] Int. Cl.[7] ..... C10M 173/00

[52] U.S. Cl. ..... 508/485; 508/496; 72/42

[58] Field of Search ..... 508/485, 496; 72/42

[56] References Cited

U.S. PATENT DOCUMENTS

| | | | |
|---|---|---|---|
| 3,912,642 | 10/1975 | Sturwold et al. | 508/494 |
| 4,151,099 | 4/1979 | Nassry et al. | 508/507 |
| 4,359,393 | 11/1982 | Sturwold et al. | 508/494 |
| 4,769,178 | 9/1988 | Kenmochi et al. | 508/485 |
| 5,284,492 | 2/1994 | Dubin | 44/301 |
| 5,707,945 | 1/1998 | Cooban et al. | 508/497 |

FOREIGN PATENT DOCUMENTS

| | | |
|---|---|---|
| WO 94/28093 | 12/1994 | WIPO . |
| WO 95/07961 | 3/1995 | WIPO . |

*Primary Examiner*—Jacqueline V. Howard
*Attorney, Agent, or Firm*—Fitch, Even, Tabin & Flannery

[57] ABSTRACT

An oil-in-water emulsion is disclosed which comprises from about 1 to about 15% by weight of an oil phase, wherein the oil phase contains from about 10 to about 60% of a $C_1$–$C_9$ alkyl of a trimer acid, from about 1 to about 10% of at least one emulsifier, from about 0.5 to about 1% of an alkaline base and from about 30 to about 88% of a hydrocarbon solvent.

19 Claims, No Drawings

EMULSION FOR THE HOT ROLLING OF NON-FERROUS METALS

FIELD OF THE INVENTION

This invention relates generally to rolling lubricants and, more particularly, to an emulsion for the hot rolling of non-ferrous metals.

BACKGROUND OF THE INVENTION

Oil-in-water emulsions are used in the hot rolling of non-ferrous metals, such as aluminum, to provide lubrication and cooling. In order to lubricate the contact between the steel roll and the aluminum strip, i.e., the roll bite, the emulsion needs to be able to form a protective film on the roll to reduce friction and to prevent metal-to-metal contact. Rolling is performed in the mixed lubrication regime. In this regime, the lubricant needs a certain viscosity to form lubricant pockets, as well as a chemistry to provide strong boundary films. It is in the boundary film that the lubricant forms a bond with the rolling surfaces.

Because of the high pressures in aluminum hot rolling, any hydrodynamic lubrication is elastohydrodynamic (EHD) lubrication. In this type of lubrication, the high pressure prior to the actual point of contact causes the viscosity of the lubricant to increase significantly. Under such conditions, the film thickness is determined by the viscosity and also the pressure viscosity coefficient, which indicates how rapidly viscosity rises with pressure.

A problem in the traditional rolling of oil formulations is the formation of metal soaps. These soaps form from the reaction of aluminum with the fatty acid included in the formulation as a boundary lubricant additive. These soaps are highly viscous and cause an increase in oil phase viscosity. The increase in viscosity causes inconsistent mill lubrication. The soaps also tend to cling to metal surfaces and, as a result, are a major problem for mills. Mill managers combat the formation of soaps by performing additive adjustments to decrease viscosity and/or full or partial emulsion dumps. Both of these scenarios are a source of downtime and expense for mill managers.

Poor lubricity is another problem often experienced in the rolling of non-ferrous metals. Poor lubricity can lead to poor quality metal and/or the inability to produce a low enough gauge.

Another source of problems is biological fouling, which is a major expense to some mills. Biocides are traditionally used to treat biological fouling, but there are safety concerns associated with the proper handling of the biocides.

Therefore, it would be highly desirable to develop a new emulsion composition which exhibits improved lubricity in the hot rolling of non-ferrous metals and which resists the formation of metal soap and biological fouling.

SUMMARY OF THE INVENTION

The oil-in-water emulsion of the present invention comprises from about 1 to about 15% by weight of an oil phase and the oil phase contains from about 10 to about 60% of a $C_1$–$C_9$ alkyl of a trimer acid, from about 1 to about 10% of at least one emulsifier, from about 0.5 to about 1% of an alkaline base and from about 30 to about 88% of a hydrocarbon solvent.

This emulsion exhibits excellent lubricity in the hot rolling of non-ferrous metals and resists the formation of metal soap and biological fouling. In fact, the emulsion can be used without the addition of a biocide. The result is an emulsion which produces consistent metal quality and increased coolant consistency with greatly reduced solution dumps and additive adjustments.

DETAILED DESCRIPTION OF THE INVENTION

The present invention is directed to an oil-in-water emulsion for use in the hot rolling of non-ferrous metals, particularly aluminum and copper. The emulsion comprises an oil phase containing preferred concentrations of a $C_1$–$C_9$ alkyl of a trimer acid, at least one emulsifier, an alkaline base and a hydrocarbon solvent. The oil phase may optionally further comprise a polyol ester of $C_{16}$–$C_{18}$ fatty acids, a castor oil ester of a dimer acid, a corrosion inhibitor and an antioxidant. The oil phase is prepared by combining the essential and optional ingredients in the amounts described below in any manner known to those skilled in the art. The oil-in-water emulsion is then made by mixing from about 1 to about 15% by weight of the oil phase with water. Preferably, the oil-in-water emulsion is made by mixing from about 2 to about 8% by weight of the oil phase with water and, most preferably, with about 3 to about 6% by weight of the oil phase.

The $C_1$–$C_9$ alkyl of a trimer acid should be present in the oil phase in the range of about 10 to about 60% by weight. The $C_1$–$C_9$ alkyl of a trimer acid may be ethyl trimerate, methyl trimerate, isopropyl trimerate, octyl trimerate or butyl trimerate. 2-ethylhexyl trimerate (PRIOLUBE 3953 available from Unichema International of Chicago, Ill.) is most preferred.

The emulsifier should be present in the oil phase in the range of about 1 to about 10% by weight, and preferably in the range of about 2 to about 5% by weight. Any appropriate emulsifier may be used in the practice of the invention, but ethoxylated secondary alcohols, ethoxylated secondary amines and mixtures thereof are preferred.

The alkaline base should be present in the oil phase in the range of about 0.5 to about 1% by weight. Although any appropriate amine or hydroxide may be used in accordance with the invention, monoethanolamine, diethanolamine, triethanolamine, sodium hydroxide and potassium hydroxide are preferred.

The hydrocarbon solvent should be present in the oil phase in the range of about 30 to about 88% by weight. The hydrocarbon solvents which may be used in the invention include napthenic and paraffinic hydrocarbons having a viscosity greater than 100 Stable Universe Seconds (SUS) at 100° F.

Optionally, a polyol ester of $C_{16}$–$C_{18}$ fatty acids and/or a castor oil ester of a dimer acid may be added to the oil phase. The polyol ester of $C_{16}$–$C_{18}$ fatty acids should be present in the oil phase in the range of about 5 to about 20% by weight. The preferred polyol ester of $C_{16}$–$C_{18}$ fatty acids is trimethylolpropane. The castor oil ester of a dimer acid should be present in the oil phase in the range of about 1 to about 10% by weight.

The oil phase may also optionally include a corrosion inhibitor. The corrosion inhibitor should be present in the oil phase in the range of about 0.5 to about 1% by weight. The corrosion inhibitors which may be used include oleoyl sarcosine and acid phosphates.

An antioxidant may also be optionally added to the oil phase. The antioxidant should be present in the oil phase in the range of about 0.5 to about 2% by weight. The preferred antioxidant is butylated hydroxytoluene.

EXAMPLES

The following examples are intended to be illustrative of the present invention and to teach one of ordinary skill how to make and use the invention. These examples are not intended to limit the invention or its protection in any way.

Example 1

Three emulsion compositions were prepared and evaluated for their use in the hot rolling of non-ferrous metals. Emulsions 1 and 2 were experimental lubricants and Emulsion 3 was prepared in accordance with this invention. Each emulsion was prepared by mixing the oil phase (the percentages are shown below in Table 1) with water, and each oil phase was prepared by mixing the ingredients at 120° F. until the mixture was homogeneous.

The oil phase of Emulsion 1 was comprised of 83.6% polyethylene glycol (PEG) 400 Dioleate, 15.0% hydrogenated castor oil ·16 EO, 1.0% butylated hydroxytoluene and 0.4% oleoyl sarcosine.

The oil phase of Emulsion 2 was comprised of 20.0% hydrogenated castor oil ·16 EO, 74.6% polyol ester, 1.0% butylated hydroxytoluene, 0.4% oleoyl sarcosine, 2.0% glycol and 2.0% ethoxylated secondary alcohol.

The oil phase of Emulsion 3 was comprised of 22.50% 2-ethylhexyl trimerate (PRIOLUBE 3953 available from Unichema International of Chicago, Ill.), 0.75% triethanolamine, 1.00% butylated hydroxytoluene, 0.40% oleoyl sarcosine, 2.00% castor oil ester of a dimer acid, 3.00% ethoxylated alcohol and 70.35% hydrocarbon oil.

Example 2

Laboratory mill rolling tests, also known as Fenn mill rolling tests, were conducted to evaluate Emulsions 1–3, prepared above in Example 1. The Fenn mill was run in the two-high mode using nominal 30" diameter rolls with a roughness of 28–32 microinches roll roughness (Ra). The metal for these tests was 5182 coil preheated to a lay-on temperature of 800° F. The initial dimensions of the coils were 6" wide ×0.25" thick (approximately 1100 lbs per coil). Four coils were contracted to be rolled with the oil, two each at two oil concentrations for each oil.

Prior to rolling, the work rolls were preheated to 145° F. The coolant was preheated to 145–150° F. Before preheating, the work rolls were cleaned with caustic to remove any residual roll coating from previous rolling tests and rinsed to prevent contamination of the next emulsion to be tested.

Coils were run at 200, 500 and 800 feet per minute (fpm) for the first, second and third passes, respectively. Rolling was started from the east and coiled on the west side for the first and third pass. The second pass was rolled from the west to east direction. The reduction schedule was 0.250" –0.175" –0.1 10" –0.055" nominally, using fixed gap rolling. Actual entry and exit gauges are shown below in Table 1.

The distance between scribed marks on the work roll was used to calculate forward slip from marks transferred to the sheet. The metal gauge and temperature were measured after each pass. Metal samples were cut from the final pass for anodizing.

A rating system of 1 to 10 was used to rate anodized quality produced on the Fenn mill under these test conditions. A rating of 1 indicates excellent quality (no pickup) and a rating of 10 indicates very poor quality. Under this system, an emulsion that produces anodized quality higher than a 4 is unlikely to perform satisfactorily as a hot aluminum tandem mill lubricant and one that produces anodized quality higher than a 7 is unlikely to function satisfactorily as a hot aluminum breakdown mill lubricant.

As shown in Table 1, the anodized quality produced from Emulsion 3 was superior to that produced from Emulsions 1 and 2. The primary criterion of good anodized quality is the lack of deep, dark streaks that will still be noticeable when the metal is cold-rolled to final gauge.

A data acquisition system was used to record some of the mill data. The data includes mill motor voltage, mill motor current, mill motor speed, entry and exit sheet speed, roll temperature and roll force. Data was collected at the rate of 2 data bursts per second. The data taken while the metal was not in the mill at all, or had just entered or exited the mill, was excluded from the analysis.

The mill motor voltage and current were combined to calculate mill motor horsepower. Roll speed and exit sheet speed were combined to calculate percent forward slip. The average of these values for each pass of each coil rolled are shown in Table 1.

Manually collected data, including metal entry and exit temperatures, sheet entry and exit gauge, and percent forward slip calculated from marks scribed on the work roll are also included in Table 1.

An examination of the average data in Table 1 shows general agreement between indicators of lubricity under fixed speed, fixed gap conditions and anodized quality achieved, namely that more lubricity produces better sheet quality. These indicators include horsepower, roll force, exit sheet gauge and percent forward slip. As shown in Table 1, Emulsion 3 was superior to Emulsions 1 and 2 as evidenced by the lower roll force and lower gauge, both of which are indicators of lower friction. Moreover, the lower horsepower indicates a lower torque on mill motors, which is also desirable.

TABLE 1

| Oil Formulation | Emulsion 1 | | | | Emulsion 2 | | | Emulsion 3 | | |
|---|---|---|---|---|---|---|---|---|---|---|
| Oil Concentration | 1.7% | 3% | 3% | 3% | 3% | 3% | 1.5% | 6% | 6% | 6% |
| Number of Data points | 313 | 307 | 316 | 328 | 282 | 307 | 310 | 326 | 317 | 336 |
| Pass Number | 1 | 1 | 1 | 1 | 1 | 1 | 1 | 1 | 1 | 1 |
| Horsepower | 205 | 208 | 195 | 188 | 199 | 188 | 196 | 156 | 164 | 183 |
| Roll Speed | 220.7 | 221.8 | 221.8 | 222.1 | 222.6 | 222.5 | 223.5 | 223.6 | 223.7 | 221.8 |
| Roll Force | 394 | 395 | 376 | 362 | 416 | 370 | 387 | 296 | 320 | 339 |
| Entry Tension Roll Speed | 171 | 173.2 | 172.9 | 170.6 | 178.6 | 173.4 | 175.7 | 169.9 | 172.4 | 169.7 |
| Exit Tension Roll Speed | 233.3 | 234.1 | 233.7 | 233.4 | 232.2 | 233.7 | 235.7 | 231.7 | 235 | 232.7 |
| Calculated % Forward Slip | 5.71 | 5.55 | 5.37 | 5.09 | 4.31 | 5.03 | 5.46 | 3.62 | 5.05 | 4.91 |
| Entry Gauge | 0.243 | 0.242 | 0.244 | 0.243 | 0.243 | 0.243 | 0.243 | 0.242 | 0.242 | 0.242 |
| Exit Gauge | 0.18 | 0.181 | 0.18 | 0.177 | 0.183 | 0.183 | 0.182 | 0.18 | 0.179 | 0.178 |
| Metal Entry Temperature | 786 | 801 | 804 | 812 | 793 | 801 | 787 | 795 | 801 | 792 |

TABLE 1-continued

| Oil Formulation | Emulsion 1 | | | | Emulsion 2 | | | Emulsion 3 | | |
|---|---|---|---|---|---|---|---|---|---|---|
| Oil Concentration | 1.7% | 3% | 3% | 3% | 3% | 3% | 1.5% | 6% | 6% | 6% |
| Metal Exit Temperature | 658 | 641 | 630 | 630 | 536 | 626 | 634 | 635 | 637 | 631 |
| Top Roll Temperature | 174 | 171 | 171 | 171 | 169 | 184 | 184 | 184 | 177 | 185 |
| Bottom Roll Temperature | 233 | 232 | 236 | 229 | 216 | 247 | 245 | 243 | 236 | 245 |
| Top Coolant Pressure | 61 | 60 | 54 | 60 | 61 | 59 | 62 | 57 | 57 | 57 |
| Bottom Coolant Pressure | 63 | 62 | 55 | 61 | 62 | 60 | 63 | 59 | 60 | 59 |
| Number of Data Points | 186 | 177 | 176 | 184 | 144 | 175 | 166 | 162 | 153 | 167 |
| Pass Number | 2 | 2 | 2 | 2 | 2 | 2 | 2 | 2 | 2 | 2 |
| Horsepower | 494 | 473 | 450 | 407 | 461 | 450 | 470 | 421 | 399 | 380 |
| Roll Speed | 491.5 | 493.7 | 492 | 494.3 | 495.4 | 494.4 | 493.3 | 492.3 | 492.5 | 508.4 |
| Roll Force | 538 | 495 | 475 | 401 | 464 | 484 | 515 | 460 | 419 | 451 |
| Entry Tension Roll Speed | 364.9 | 356.1 | 352.2 | 338.1 | 347.6 | 359.5 | 363.1 | 364.8 | 352.4 | 367.2 |
| Exit Tension Roll Speed | 521.5 | 523.1 | 520.7 | 522.8 | 520.7 | 522.7 | 523.2 | 519 | 523 | 539.8 |
| Calculated % Forward Slip | 6.1 | 5.96 | 5.83 | 5.77 | 5.11 | 5.72 | 6.06 | 5.42 | 6.19 | 6.18 |
| Entry Gauge | 0.18 | 0.181 | 0.18 | 0.177 | 0.183 | 0.183 | 0.182 | 0.18 | 0.179 | 0.178 |
| Exit Gauge | 0.12 | 0.117 | 0.117 | 0.113 | 0.121 | 0.118 | 0.12 | 0.124 | 0.1175 | 0.115 |
| Metal Entry Temperature | 658 | 641 | 630 | 630 | 536 | 626 | 634 | 635 | 637 | 631 |
| Metal Exit Temperature | 599 | 578 | 549 | 546 | 549 | 554 | 571 | 572 | 578 | 565 |
| Top Roll Temperature | 242 | 238 | 249 | 239 | 222 | 240 | 243 | 244 | 237 | 240 |
| Bottom Roll Temperature | 231 | 231 | 234 | 232 | 230 | 241 | 235 | 254 | 246 | 250 |
| Top Coolant Pressure | 65 | 64 | 39 | 42 | 65 | 64 | 66 | 62 | 61 | 63 |
| Bottom Coolant Pressure | 64 | 63 | 39 | 42 | 63 | 62 | 64 | 61 | 60 | 62 |
| Number of Data Points | 150 | 153 | 120 | 86 | 136 | 147 | 140 | 158 | 159 | 198 |
| Pass Number | 3 | 3 | 3 | 3 | 3 | 3 | 3 | 3 | 3 | 3 |
| Horsepower | 858 | 789 | 752 | 681 | 792 | 795 | 853 | 732 | 564 | 697 |
| Roll Speed | 803.4 | 802.6 | 804.1 | 804.6 | 804.2 | 804.1 | 804.1 | 804.1 | 805 | 804.9 |
| Roll Force | 606 | 552 | 534 | 461 | 555 | 577 | 644 | 479 | 327 | 455 |
| Entry Tension Roll Speed | 491.2 | 470.4 | 478.6 | 445.4 | 483.9 | 495.5 | 514.9 | 453.4 | 367.7 | 430.5 |
| Exit Tension Roll Speed | 882.5 | 872.8 | 870.5 | 868.7 | 865.4 | 876.8 | 878 | 873.8 | 810.8 | 877.6 |
| Calculated % Forward Slip | 9.85 | 8.75 | 8.26 | 7.97 | 7.61 | 9.04 | 9.19 | 8.67 | 0.72 | 9.03 |
| Measured % Forward Slip | No Data | 10.96 | 11.23 | 10.28 | 10.55 | 11.97 | 12.11 | 12.04 | 2.63 | 12.11 |
| Entry Gauge | 0.12 | 0.117 | 0.117 | 0.113 | 0.121 | 0.118 | 0.12 | 0.124 | 0.1175 | 0.115 |
| Exit Gauge | 0.068 | 0.0645 | 0.064 | 0.056 | 0.0675 | 0.068 | 0.072 | 0.0645 | 0.053 | 0.056 |
| Metal Entry Temperature | 599 | 578 | 549 | 546 | 549 | 554 | 571 | 572 | 505 | 565 |
| Metal Exit Temperature | 568 | 548 | 565 | 570 | 537 | 591 | 596 | 622 | 487 | 572 |
| Top Roll Temperature | 202 | 195 | 199 | 219 | 205 | 223 | 226 | 222 | 188 | 225 |
| Bottom Roll Temperature | 237 | 239 | 237 | 283 | 259 | 289 | 296 | 274 | 222 | 293 |
| Top Coolant Pressure | 61 | 60 | 48 | 26 | 60 | 53 | 61 | 56 | 59 | 58 |
| Bottom Coolant Pressure | 63 | 62 | 51 | 28 | 61 | 54 | 62 | 58 | 62 | 61 |
| Anodized Quality Rating | 9 | 9 | 9 | 8 | 8 | 9 | 9 | 4.5 | 3 | 3 |

Example 3

Emulsions 1–3 from Example 1 were evaluated for their resistance to bacterial growth. A representative sample was taken from each emulsion and quantified on Tryptone Glucose Extract (TGE) agar for the determination of microbial growth present prior to a bacterial spike.

Using a fresh culture, bacterial cells were harvested using a centrifuge for 10 minutes at 10,000 rpm. The supernatent was discarded and pellet washed and resuspended in 10 ml of phosphate buffer, pH 7.5, for a cell concentration of approximately $2.05\times10^8$ colony forming units (CFU)/ml.

Of the resuspended cells, 0.5 ml were added to the appropriate sterile jar containing 50.0 ml of sample for an initial cell concentration of approximately $2.11\times10^5$ CFU/ml. Samples were mixed well prior to sampling to obtain a representative sample. Serial dilutions were performed in buffer blanks and quantified on TGE agar for bacterial enumeration. Viable organisms were enumerated at times: 0 hour, 24 hours, 48 hours and 1 week. A time "0" was taken to determine any immediate effect on bacterial viability. Samples were placed on an orbital shaker and incubated at 37° C. throughout the evaluation period.

As shown below in Table 2, viable bacteria were present in Emulsion 1 at the onset. Bacterial growth was also seen in Emulsion 2 and after one week, dramatic bacterial growth was observed. However, there was no viable bacterial growth associated with Emulsion 3.

TABLE 2

| Samples | 0 Hours | 24 Hours | 48 Hours | 1 Week |
|---|---|---|---|---|
| | Bacterial Counts on TGE (CFU/ml) | | | |
| Emulsion 1 | $7.60\times10^3$ | $3.6\times10^5$ | $8.0\times10^6$ | $7.7\times10^6$ |
| Emulsion 2 | $1\times10^1$ | $<10^1$ | $9\times10^1$ | $6.4\times10^4$ |
| Emulsion 3 | $<10^1$ | $<10^1$ | $<10^1$ | $<10^1$ |

Emulsions 1–3 were then inoculated with $10^5$ CFU/ml of a pure *Pseudomonas aeruginosa* PAO1 culture and monitored for growth and sustenance. The culture was grown overnight in tryptic soy broth and incubated at 37° C.

As shown below in Table 3, Emulsions 1 and 2 sustained bacterial growth. Emulsion 3, however, demonstrated a complete decrease in cell viability.

TABLE 3

| Samples | 0 Hours | 24 Hours | 48 Hours | 1 Week |
|---|---|---|---|---|
| | Bacterial Counts on TGE (CFU/ml) | | | |
| Emulsion 1 | $1.49\times10^5$ | $9.7\times10^6$ | $1.17\times10^7$ | $1.17\times10^7$ |
| Emulsion 2 | $1.30\times10^5$ | $8.8\times10^6$ | $7.3\times10^6$ | $2.93\times10^6$ |
| Emulsion 3 | $<10^2$ | $<10^1$ | $<10^1$ | $<10^1$ |

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. An oil-in-water emulsion comprising from about 1 to about 15% by weight of an oil phase, wherein the oil phase comprises:

from about 10 to about 60% of a $C_1$–$C_9$ alkyl of a trimer acid;

from about 1 to about 10% of at least one emulsifier;

from about 0.5 to about 1% of an alkaline base; and from about 30 to about 88% of a hydrocarbon solvent.

2. The emulsion of claim 1 wherein the emulsion comprises from about 2 to about 8% by weight of an oil phase.

3. The emulsion of claim 1 wherein the emulsion comprises from about 3 to about 6% by weight of an oil phase.

4. The emulsion of claim 1 wherein the $C_1$–$C_9$ alkyl of a trimer acid is selected from the group consisting of ethyl trimerate, methyl trimerate, isopropyl trimerate, octyl trimerate and butyl trimerate.

5. The emulsion of claim 4 wherein the $C_1$–$C_9$ alkyl of a trimer acid is 2-ethylhexyl trimerate.

6. The emulsion of claim 1 wherein the emulsifier is selected from the group consisting of ethoxylated secondary alcohols, ethoxylated secondary amines and mixtures thereof.

7. The emulsion of claim 1 wherein the alkaline base is selected from the group consisting of monoethanolamie, diethanolamine, triethanolamine, sodium hydroxide and potassium hydroxide.

8. The emulsion of claim 1 wherein the hydrocarbon solvent is selected from the group consisting of napthenic and paraffinic hydrocarbons having a viscosity greater than 100 SUS at 100° F.

9. The emulsion of claim 1 wherein the oil phase further comprises from about 5 to about 20% of a polyol ester of $C_{16}$–$C_{18}$ fatty acids.

10. The emulsion of claim 9 wherein the polyol ester of $C_{16}$–$C_{18}$ fatty acids is trimethylolpropane.

11. The emulsion of claim 1 wherein the oil phase further comprises from about 1 to about 10% of a castor oil ester of a dimer acid.

12. The emulsion of claim 1 wherein the oil phase further comprises from about 0.5 to about 1% of a corrosion inhibitor.

13. The emulsion of claim 12 wherein the corrosion inhibitor is selected from the group consisting of oleoyl sarcosine and acid phosphates.

14. The emulsion of claim 1 wherein the oil phase further comprises from about 0.5 to about 2% of an antioxidant.

15. The emulsion of claim 14 wherein the antioxidant is butylated hydroxytoluene.

16. An oil-in-water emulsion comprising from about 1 to about 15% by weight of an oil phase, wherein the oil phase comprises:

from about 10 to about 60% of a $C_1$–$C_9$ alkyl of a trimer acid;

from about 1 to about 10% of at least one emulsifier;

from about 0.5 to about 1% of an alkaline base;

from about 30 to about 88% of a hydrocarbon solvent;

from about 5 to about 20% of a polyol ester of $C_{16}$–$C_{18}$ fatty acids;

from about 0.5 to about 1% of a corrosion inhibitor; and from about 0.5 to about 2% of an antioxidant.

17. The emulsion of claim 16 wherein the oil phase further comprises from about 1 to about 10 % of a castor oil ester of a dimer acid.

18. An oil-in-water emulsion comprising from about 1 to about 15% by weight of an oil phase, wherein the oil phase comprises:

from about 10 to about 60% of a $C_1$–$C_9$ alkyl of a trimer acid;

from about 1 to about 10% of at least one emulsifier;

from about 0.5 to about 1% of an alkaline base;

from about 30 to about 88% of a hydrocarbon solvent;

from about 1 to about 10% of a castor oil ester of a dimer acid;

from about 0.5 to about 1% of a corrosion inhibitor; and from about 0.5 to about 2% of an antioxidant.

19. The emulsion of claim 18 wherein the oil phase further comprises from about 5 to about 20% of a polyol ester of $C_{16}$–$C_{18}$ fatty acids.

* * * * *